US006032658A

United States Patent [19]

Miwa et al.

[11] Patent Number: 6,032,658

[45] Date of Patent: Mar. 7, 2000

[54] IGNITION SYSTEM HAVING IGNITION COIL

[75] Inventors: Tetsuya Miwa; Yukio Kunieda, both of Nagoya; Isao Goto, Toyota, all of Japan

[73] Assignee: Denso Corporation, Kariya, Japan

[21] Appl. No.: 08/989,035

[22] Filed: Dec. 11, 1997

[30] Foreign Application Priority Data

Dec. 19, 1996 [JP] Japan ..... 8-340022

[51] Int. Cl.[7] ..... F02P 1/00

[52] U.S. Cl. ..... 123/655; 123/656

[58] Field of Search ..... 123/655, 656, 123/645

[56] References Cited

U.S. PATENT DOCUMENTS 4,556,040 12/1985 Heyke ..... 123/655

4,653,460 3/1987 Ooyabu et al. .

5,377,653 1/1995 Hamada et al. ..... 123/655

5,594,616 1/1997 Bretch et al. ..... 123/655

*Primary Examiner*—John Kwon

*Attorney, Agent, or Firm*—Nixon & Vanderhye P.C.

[57] ABSTRACT

An ignition system includes an ignition coil which provides ignition voltage of one polarity, an igniter which supplies the primary current to the ignition coil at regular timings and a zener diode connected in series with the primary coil of the ignition coil. The zener diode shares a constant voltage drop of the opposite polarity at the secondary coil of the ignition coil, thereby reducing troublesome voltage induced in the secondary coil other than at regular ignition timings. On the other hand, the zener diode does not share the voltage drop of the ignition voltage at the regular timings, and thus no energy loss is incurred.

7 Claims, 1 Drawing Sheet

IGNITION SYSTEM HAVING IGNITION COIL

BACKGROUND OF THE INVENTION

1. Field of the Invention

The present invention relates to an ignition system having an ignition coil for an internal combustion engine.

2. Description of the Related Art

In a so-called distributor-less ignition system in which an ignition coil and a spark plug are integrally combined, a spark may be generated at the spark plug when current is supplied to the primary coil of the ignition coil at a timing other than the ignition timing. Such a spark causes abnormal vibration of an engine.

Such a troublesome spark can be prevented if a diode is connected between terminals of the primary and secondary coils so that the current induced in the secondary coil can flow to the primary coil, because the direction of the induced voltage (on-voltage) causing the troublesome spark is opposite to the direction of the regular ignition voltage. The troublesome spark can be also prevented if a diode is inserted in series with the spark gap of the spark plug to cut spark current flowing in the direction opposite to the regular ignition spark current. An additional spark gap connected in series with the spark plug gap can also prevent the troublesome spark.

However, such a diode to be used in a high tension circuit for the above purpose is expensive, and the space in the ignition coil to install the diode is limited. The additional spark gap requires an additional space and parts such as terminal members. The additional spark gap also increases the energy loss.

U.S. Pat. No. 4,653,460 discloses an ignition system using a zener diode connected in the high tention circuit of the ignition coil to improve the above problem. However, the zener diode is substituted for the regular diode only to pass the backward current when the on-voltage becomes higher than the breakdown voltage that is 2 k to 4 kvolts. This zener diode is still expensive and bulky, because such zener diode consumes large energy and must have a large heat dissipation surface.

SUMMARY OF THE INVENTION

Therefore, a main object of the present invention is to provide an improved ignition system for an engine which prevents the troublesome spark without requiring additional space or cost.

According to a main feature of the present invention, an ignition system comprises an ignition coil for providing ignition voltage of one polarity, an igniter for controlling current supplied to the primary coil and a zener diode disposed in the ignition coil or in the igniter to provide substantially no voltage drop in the ignition voltage and a constant voltage drop in the voltage induced at timings other than the regular timings. The breakdown voltage of the zener diode is lower than 1.5 kV so that the voltage induced at timings other than the regular ignition timing is supressed to lower than 1.18 kvolts.

According to another feature of the present invention, the ignition system comprises an ignition coil for providing ignition voltage in one polarity and an igniter having a constant voltage circuit. The constant voltage circuit has a transistor connected in series with the primary coil and a zener diode, and limits a maximum voltage applied to the primary coil when the igniter supplies current to the primary coil.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
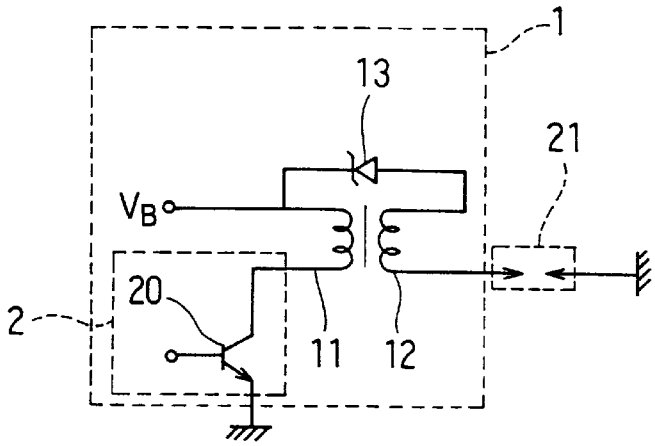
FIG. 1 is a circuit diagram of an ignition coil according to a first embodiment of the present invention.

An ignition system according to a first embodiment is described with reference to FIGS. 1 and 2.

An ignition coil 1 is installed in a plug hole formed in a cylinder block of an engine (not shown) along with a spark plug combined integrally therewith. The ignition coil 1 has a primary coil 11 and a secondary coil 12. The primary coil 11 has a battery-side terminal providing battery voltage $V_B$ to which a battery (not shown) is connected and a switch-side terminal to which a switching transistor 20 of an igniter is connected, so that battery voltage $V_B$ is applied to the primary coil 11 by the switch 20. A zener diode 13 is connected between the battery-side terminal $V_B$ of the primary coil and the low-side terminal (the terminal opposite to the terminal connected to the spark plug) of the secondary coil so that current in the secondary coil 12 caused by voltage (hereinafter referred to as the on-voltage) induced when current is supplied to the primary coil can be conducted therethrough. The zener diode 13 is a flat bare chip type, and is mounted on a circuit module of the igniter 2 integrated into the ignition coil 1.

Figure 2:
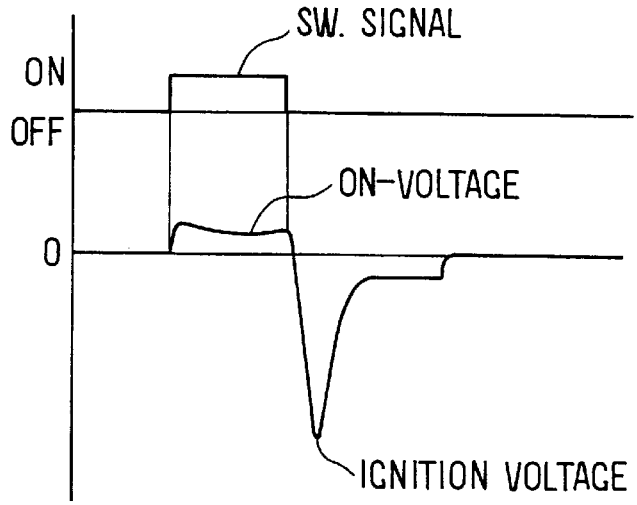
FIG. 2 is a graph showing a switching signal and voltage induced in the secondary coil of the ignition coil according to the first embodiment.

When a switching signal to be applied to the base of the switching transistor 20 as shown in FIG. 2, primary current is supplied to the primary coil 11. As the primary current increases gradually, the on-voltage is induced in the secondary coil 12 and applied to the spark plug. However, because the zener diode 13 is connected in series with the spark plug to interrupt current caused by the on-voltage, the voltage applied to the spark plug is mainly shared by the zener diode and the troublesome spark can be prevented if the voltage shared by the zener diode is lower than the breakdown voltage thereof. Even if the zener diode breaks down, it shares a part of the on-voltage which is the breakdown voltage. According to test results, the troublesome spark can be prevented if the on-voltage is not higher than 1.18 kV. If the breakdown voltage of the zener diode is higher than 500 volts, the on-voltage applied to the spark plug can be reduced to a voltage lower than 1.18 kV. In view of the insulation structure of the zener diode, it is preferable that the breakdown voltage thereof is lower than 1.5 kV.

On the other hand, when the switching signal changes from on-signal to off-signal and the switching transistor 20 is turned off, an ignition voltage is generated in the direction opposite to the on-voltage in the secondary coil 12 so that the regular ignition spark can be generated without voltage drop or energy loss.

The zener diode 13 can be connected between the spark plug and the output terminal of the secondary coil 12. The igniter 2 can be separated from the ignition coil 1 so that a plurality of the ignition coils can be controlled by the single igniter 2. In this case, the zener diode can be disposed at a portion near the ignition coil 1 outside the igniter 2.

(Second embodiment)

Figure 3:
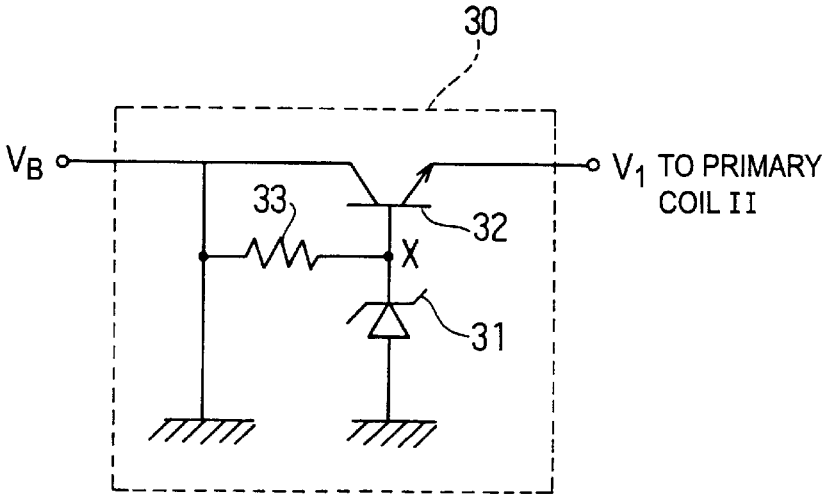
FIG. 3 is a circuit diagram of a constant voltage circuit of an igniter according to a second embodiment.

An ignition system according to a second embodiment is described with reference to FIG. 3.

A constant voltage circuit 30 having a zener diode 31 and a transistor 32 is disposed in the igniter and connected between the primary coil 11 and the battery. The constant voltage circuit 30 controls the output voltage V1 applied to the primary coil 11 to be lower than the battery voltage $V_B$. The breakdown voltage of the zener diode 31 is 14.5 volts, and the voltage drop between the base and emitter of the transistor 32 is 0.5 volt. The output voltage V1 changes as the battery voltage $V_B$ changes as follows:

(1) When the battery voltage $V_B$ is equal to or lower than 14.5 V, the output voltage V1 is equal to or lower than about 14 V, that is, about 0.5 volt (the voltage drop of the transistor 32) lower than the battery voltage $V_B$.

(2) When the battery voltage $V_B$ is higher than 14.5 V, the zener diode 31 breaks down so that the potential of the base X is maintained 14.5 V, and, thus, the output voltage V1 becomes 14 V that is lower 0.5 V than the potential of base X.

Since the maximum output voltage is controlled to be constant, the on-voltage induced in the secondary voltage is controlled to be lower than the voltage which may cause the troublesome spark. On the other hand, the ignition voltage is generated at the regular timings without energy loss.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. An ignition system comprising:

an ignition coil having a primary coil and a secondary coil for providing ignition voltage of one polarity at said secondary coil;

an igniter having a switching element for controlling current supplied to said primary coil to generate said ignition voltage at regular ignition timings; and a zener diode disposed in one of said ignition coil and said igniter to provide substantially no voltage drop in a direction of said one polarity and a constant voltage drop in the opposite direction, thereby reducing voltage induced in said secondary coil other than at regular ignition timings, wherein said ignition coil generates an on-voltage lower than 1.18 kv when said igniter supplies current to said primary coil.

2. An ignition system for supplying ignition voltage to a spark plug, said system comprising:

a battery;

an ignition coil having a primary coil having one end connected to said battery and a secondary coil having one end connected to said spark plug;

an igniter for controlling primary current supplied from said battery to said primary coil to generate said ignition voltage at regular ignition timings; and a zener diode connected between said one end of said primary coil and the other end of said secondary coil in such a polarity that said zener diode provides substantially no voltage drop when said ignition voltage is applied to said spark plug, wherein said ignition coil is arranged so that, but for the presence of said zener diode, said secondary coil can generate on-voltage higher than 1.18 kv when said primary current is supplied to said primary coil, and said zener diode has a prescribed breakdown voltage to thereby reduce said on-voltage to be less than 1.18 kv and higher than zero volts.

3. An ignition system as claimed in claim 2, wherein breakdown voltage of said zener diode is lower than 1.5 kV.

4. An ignition system as claimed in claim 2, wherein said zener diode is disposed in said ignition coil.

5. An ignition system as claimed in claim 2, wherein said igniter comprises a circuit module and is integrated in said ignition coil, and said zener diode is mounted on said circuit module.

6. An ignition system as in claim 2 further comprising a constant voltage circuit having a transistor connected in series with said battery and said primary coil.

7. An ignition system comprising:

an ignition coil having a primary coil and a secondary coil for providing ignition voltage of one polarity at said secondary coil;

an igniter having a switching element for supplying current to said primary coil at regular ignition timings; and a zener diode connected in series with said secondary coil to provide substantially no voltage drop in the direction of said one polarity and a constant voltage drop in the opposite direction, thereby reducing voltage induced in said secondary coil at other than said regular ignition timings to be less than 1.18 kv even though the ignition coil is otherwise capable of generating a higher on-voltage.

* * * * *